United States Patent [19]

Pawlowski et al.

[11] Patent Number: 5,074,553

[45] Date of Patent: Dec. 24, 1991

[54] BOWLING BALL

[75] Inventors: Michael R. Pawlowski, Muskegon; Bill Wasserberger, Spring Lake, both of Mich.

[73] Assignee: Brunswick Corporation, Skokie, Ill.

[21] Appl. No.: 660,680

[22] Filed: Feb. 25, 1991

[51] Int. Cl.[5] ..... A63B 37/06

[52] U.S. Cl. ..... 273/63 E

[58] Field of Search ..... 273/63 R, 63 A, 63 B, 273/63 C, 63 D, 63 E, 63 F, 63 G, DIG. 8

[56] References Cited

U.S. PATENT DOCUMENTS

| | | | |
|---|---|---|---|
| 1,062,069 | 5/1912 | Bendelari | 273/63 E |
| 2,291,738 | 8/1942 | Luth et al. | 273/63 E |
| 3,181,864 | 5/1965 | Rolke | 273/63 E |
| 3,865,369 | 2/1975 | Randolph | 273/63 E |
| 4,058,310 | 11/1977 | Miettinen | 273/63 E |
| 4,121,828 | 10/1978 | Amburgey | 273/63 E |
| 4,131,277 | 12/1978 | Randolph | 273/63 D |
| 4,183,527 | 1/1980 | Amburgey | 273/63 E |
| 4,264,071 | 4/1981 | Randolph | 273/63 E |
| 4,268,034 | 5/1981 | MacDonald | 273/63 C |
| 4,320,899 | 3/1982 | Salvino | 273/63 E |
| 4,592,551 | 6/1986 | Lee | 273/63 E |
| 4,665,454 | 4/1987 | Amburgey | 273/63 E |
| 4,802,671 | 2/1989 | Gentiluomo | 273/63 E |
| 4,913,429 | 4/1990 | Fabanich | 273/63 E |

*Primary Examiner*—George J. Marlo

*Attorney, Agent, or Firm*—Wood, Phillips, Mason, Recktenwald & VanSanten

[57] ABSTRACT

A bowling ball includes a spherical inner core and an outer shell. An annular weight block is mounted symmetrically on a mid-plane of the inner core and is axisymmetric about a centerline passing through the geometric center of the spherical body. An eccentric weight block is formed integrally with a portion of the annular weight block. The annular weight block is oriented such that the longitudinal centerline is positioned in a preferred attitude relative to the bowler release axis for controlling migration of a bowling ball spin axis from the bowler release axis to the longitudinal axis of the annular weight block as the ball slides and rolls down a lane.

30 Claims, 1 Drawing Sheet

Fig. 1
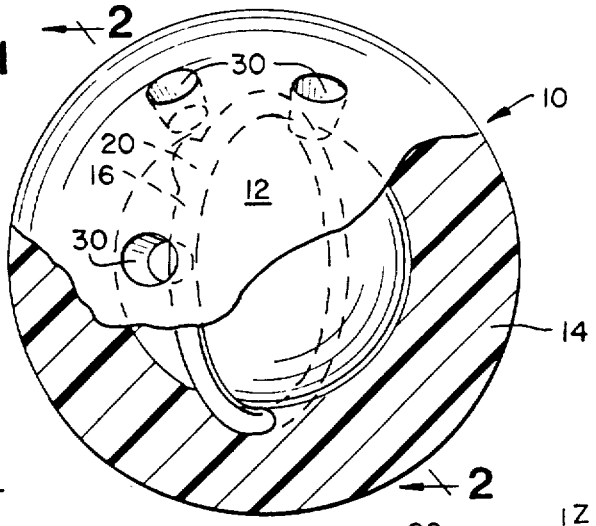
Fig. 2
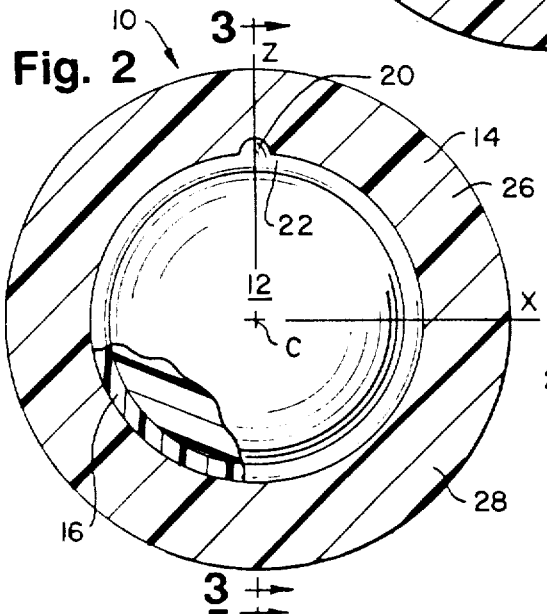
Fig. 3
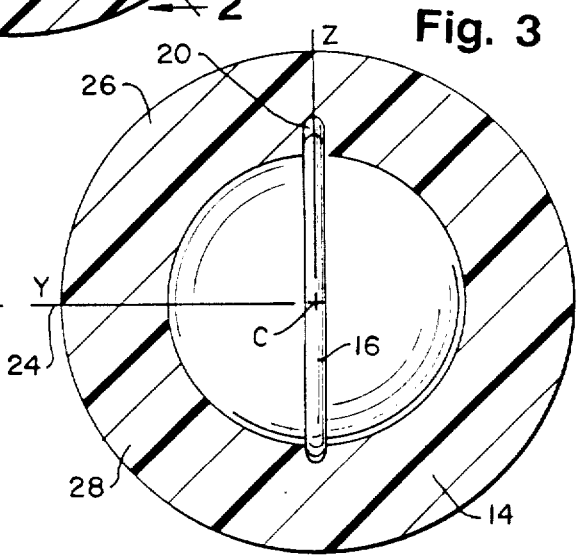
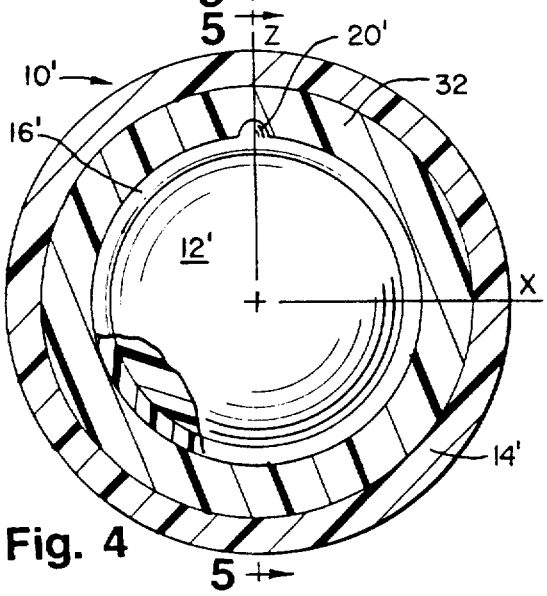
Fig. 4
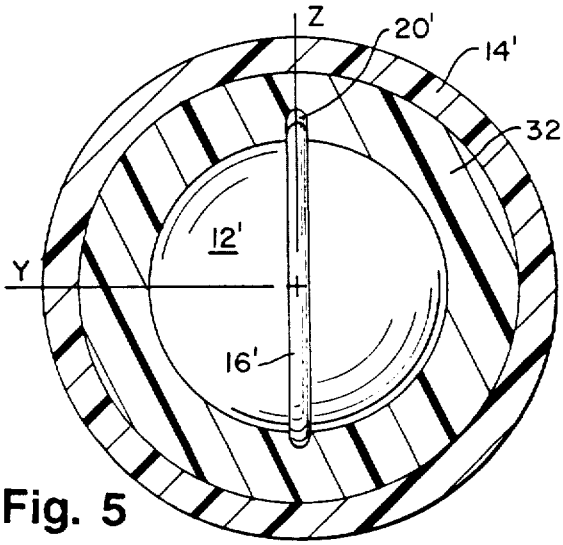
Fig. 5

BOWLING BALL

BACKGROUND OF THE INVENTION

1. Technical Field

The present invention relates generally to bowling balls, and more particularly, a bowling ball having a novel mass distribution for establishing an enhanced preferential spin axis such that the bowling ball exhibits predictable dynamic characteristics.

2. Background Art

Bowling balls used in events sanctioned by the American Bowling Congress must conform to certain specifications. For example, the ball cannot weigh more than 16 pounds and must have a circumference of between 26.784 and 27.002 inches. The ball is normally provided with appropriately spaced finger holes for reception of the thumb, middle finger and ring finger. The geometric center of the drilled holes for gripping define the "Top" of the ball. After the ball is drilled, it must be balanced statically in three planes as follows: 1 onuce + or− from the left half of the ball to the right half through the vertical midplane which passes through the center of the grip, 1 ounce + or− from the finger to the thumb half of the ball through the vertical midplane which passes through the center of the grip perpendicular to the first plane, and 3 ounces + or− from the top to the bottom half of the ball through the horizontal midplane referenced to the grip center.

Skillful bowlers roll the ball so that it enters the pin placement at an angle with respect to the longitudinal axis of the bowling lane. It is known that larger angles of entry results in a larger area of impact to result in a strike or knocking all ten pins down with one roll of the ball. A skillful bowler can maximize this entry angle by throwing the ball so that it follows a curved path down the lane as it approaches the pins.

To achieve the desired curved path of the bowling ball, the bowler applies several components of motion. The first is the translational velocity of the ball towards the pins. The second is a combination of forward rotation (parallel to the longitudinal axis of the lane) and side rotation (perpendicular to the longitudinal axis of the lane). Skillful bowlers vary the ratio of forward rotation to side rotation in order to regulate the amount of hook or curve imparted to the ball. The friction between the ball and the lane surface combined with the rotation of the ball creates the curved path of the ball.

It is generally known in the field of bowling balls to incorporate weight blocks into the design thereof to compensate for the weight removed by drilling the grip holes. The weight blocks are traditionally placed in the "top" of the ball and provide a small degree of dynamic balance to the ball as it rolls down the lane. It is also known that by manipulating these weight blocks, a higher degree of hook can be obtained without violating the rules which govern the balance of the ball. This additional hooking action on the ball results from the dynamics associated with an object in rotation.

Turning to the laws of physics, a freely rotating object tends to rotate about its most stable axis of rotation. The most stable axis of rotation is the axis about which the object possesses the maximum moment of inertia, or the largest resistance to rotation This axis is referred to as the principal, primary, or dominant axis of rotation. The second most stable axis is the axis about which the object possesses the minimum moment of inertia, also a principal axis known as the secondary axis. If a rotational force or torque is initially applied to the object in such a manner as to induce rotation about an axis which is not a principal axis of rotation, the axis about which the freely rotating object will spin will gradually migrate from the original axis to the primary axis associated with the maximum moment of inertia of the object. Rotation of an object about the secondary axis is not ultimately stable therefore any disturbance of the rotation will also cause the migration to the primary axis The same physical behavior described above applies to the dynamic response of bowling balls. A bowler releases the ball in such a manner prescribed by the rotational force or torque applied at release to rotate about a particular axis on the ball. As the ball moves down the lane, the axis about which the ball is spinning tends to migrate toward the principal axis associated with the maximum moment of inertia of the ball.

While the ball is traveling down the lane, oil, which is applied to the lane to protect the surface, adheres to that portion of the ball which contacts with the lane, thereby reducing the friction of the interactive surfaces. During the migration of the spin axis, the ball rotates in such a fashion that the portion of the ball which does not contact the lane during the early parts of the ball trajectory, and thus remains "dry" comes into contact with the lane at points further down the lane. When the "dry" ball surface comes into contact with the lane surface, the frictional forces are maximized which results in a larger curved path. Without spin axis migration, this reduced friction will result in a smaller curved path that is less than that of a ball with induced spin axis migration.

The problem with current bowling ball design is that the primary axis of rotation is not strong enough at the time of manufacture to remain the primary axis after the ball is drilled, due to the alteration of moment of inertia caused by the drilling of the grip holes. In other words, the difference between the maximum and minimum moments of inertia is not large enough to remain in the same orientation when the grip holes are introduced. Current bowling ball designs are marginally stable about their minimum moment of inertia, as such they possess a line of minimum moment of inertia, and a plane of potential maximum moments of inertia near the horizontal midplane of the ball based on the removal of material during drilling. Because the axis of release is subject to the variability of a particular bowler, and because the primary axis of the ball does not correspond to the release axis of the bowler, the corresponding dynamic response is subject to a higher degree of variability as the spin axis migrates from the different intermediate axis to the primary spin axis.

Randolph U.S. Pat. No. 3,865,369 and Gentiluomo U.S. Pat. No. 4,882,671 both illustrate bowling balls having a top weighted hemisphere with a stable axis only about the minimum moment of inertia. As described above, these designs result in largely unpredictable responses.

Prior art fails to disclose a bowling ball having a differential moment of inertia large enough to maintain the maximum moment of inertia as the maximum moment of inertia after the removal of material for the grip holes. The present invention is directed toward overcoming one or more of the problems set forth above.

SUMMARY OF THE INVENTION

An object of the present invention, therefore, is to provide a new and improved bowling ball having a novel mass distribution for establishing an enhanced preferential spin axis such that the bowling ball exhibits predictable dynamic characteristics.

In the exemplary embodiment, a bowling ball includes a two piece spherical body having an inner core formed by a mixture of barium sulfate, calcium carbonate, glass microspheres and a polyester binder encapsulated by an outer core formed of polyurethane. An annular weight block is mounted symmetrically on a mid-plane of the inner core and is axi-symmetric about a centerline passing through the geometric center of the spherical body. An eccentric weight block is formed integrally with a portion of the annular weight block, with the size and position of the eccentric weight block being such that there is minimal concentrated residual weight provided by the eccentric weight block after drilling.

In order to facilitate handling of the ball, a number of grip holes are drilled into the ball and help to establish a bowler release axis for the ball. The annular weight block is oriented such that the longitudinal centerline is positioned in a preferred attitude relative to the bowler release axis for controlling migration of a bowling ball spin axis from the bowler release axis to the longitudinal axis of the annular weight as the ball slides and rolls down a lane. The longitudinal axis of the annular weight defines a primary axis of rotation for the ball which is independent of the position of the grip holes. The migration can be eliminated by placing the longitudinal axis of the annular weight coincident with the release axis of the bowler.

In an alternative embodiment of the invention, the bowling ball has a three piece spherical body with an intermediate core formed by a mixture of a polyester binder with low density hollow glass microspheres and calcium carbonate to centralize the ball weight near the inner core and thereby reduce the overall moment of inertia of the ball, and increase the different between the maximum and minimum moments of inertia.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

FIG. 1 is a perspective view in partial section of a bowling ball embodying the present invention;

FIG. 2 is a sectional view taken along line 2—2 of the bowling ball illustrated in FIG. 1;

FIG. 3 is a sectional view taken along line 3—3 of the bowling ball illustrated in FIG. 2;

FIG. 4 is a sectional view taken along a vertical midplane of an alternate embodiment of the present invention; and FIG. 5 is a sectional view taken along line 5—5 of the bowling ball illustrated in FIG. 4.

DESCRIPTION OF THE PREFERRED EMBODIMENT

A bowling ball according to the present invention is shown in FIG. 1, and generally at 10, as having a spherical inner core 12 encapsulated by a spherical outer shell 14. Formed integrally with inner core 12 is a symmetric annular projection or weight block 16 extending circumferentially about a vertical midplane of the inner core and an eccentric lug or weight block 20 formed integrally with a top portion 22 of annular weight block 16.

Spherical inner core 12 is composed at least in part of a mixture of barium sulfate, calcium carbonate and/or glass microspheres together with a polyester binding resin. Similarly, annular weight block 16 and eccentric weight block 20 are composed at least in part of an identical mixture of barium sulfate calcium carbonate and glass microspheres together with a polyester binding resin and together with the inner core define a high density ball center. Outer spherical shell 14 comprises a thick layer of lower density cover material, such as polyurethane, to protectively shield the inner core. By encapsulating the high density ball center with a layer of lower density polyurethane, the overall moment of inertia of the ball is reduced while maintaining a maximum allowable ball weight.

Annular weight block 16 is formed as an axi-symmetric flange integrally molded with the inner core and has a longitudinal axis of symmetry 24 intersecting the geometric center C of the ball. Well established physical principles provide that the axis of maximum moment of inertia for an annular mass, and therefore annular weight block 14, lies on longitudinal ball axis 24.

As shown in FIGS. 1-3, the x-y plane defines a horizontal midplane separating a ball top hemisphere 26 from a ball bottom hemisphere 28. To permit gripping of the bowl by a bowler, a number of finger holes 30 are drilled into the outer shell 14 somewhere in the ball top hemisphere 26. Eccentric weight block 20 is disposed on annular weight block 16 to compensate for the loss of mass in the top hemisphere of the ball due to the voids created by the finger holes.

From a bowler's perspective, use of the invention occurs in a traditional manner. A bowler engages the finger holes 30 with his thumb and a number of adjacent fingers and swings his arm backward and forward to propel the ball toward a bowling pin arrangement at the end of a bowling lane. The ball assumes any one of an infinity of trajectories as it rolls and slides along the lane and ultimately, depending on the degree of proficiency of the bowler and ball trajectory assumed, strikes a number of the pins to determine a score.

The novel bowling ball construction described hereinabove allows a bowler to enhance the trajectory which the ball will follow as it rolls and slides along the lane. In order to fully comprehend the novelty presented in the above described structure, it is helpful to consider the general dynamic behavior of a rotating rigid body.

Resistance to linear motion of a mass is commonly understood to embody the phenomenon of inertia, that is, a body at rest tends to remain at rest in the absence of an external force and, likewise, a body in motion tends to remain in motion in the absence of an external force to the contrary. Rotational analogues to the concept of linear inertia also exist and are known as moments of inertia, or resistance of an object to rotate or to cease rotating about a particular axis. Depending on the distribution of mass within an object, some axes may be associated with a greater resistance to rotation than others.

When using the laws of physics, it is useful to express the moment of inertia characteristics of a rigid body in a mathematical form. To that end, an inertia tensor is represented as:

| | | |
|---|---|---|
| Ix | Ixy | Ixz |
| Ixy | Iy | Iyz |
| Ixz | Iyz | Iz |

where the diagonal terms Ix, Iy, and Iz represent moments of inertia about a set of orthogonal axes x, y, and z (see FIGS. 2 and 3) and the remaining terms comprise quantities known as products of inertia which describe the manner in which the mass of a rigid body is distributed with respect to the chosen x, y, and z axes. For a completely symmetric body with the x, y, and z axes arbitrarily chosen to be aligned with axes of symmetry of the body, the products of inertia all are equal to zero. In this situation, the x, y, and z axes are known as principle axes of inertia and the quantities Ix, Iy, and Iz are known as principle moments of inertia.

For reasons beyond the scope of this discussion, a rotating rigid body will have an optimally stable spin axis about the maximum of the principle moments of inertia Ix, Iy, and Iz and a relatively stable spin axis about the minimum of the three principle moments of inertia. Once an object is freely rotating about a principle axis of maximum inertia, the object will continue to spin in a highly stable manner. An object initially rotating about a relatively stable spin axis or another axis sufficiently close to a relatively stable spin axis will behave differently. As the object rotates, the spin axis gradually will migrate toward the principle axis of maximum inertia, until finally the spin axis becomes stabilized.

The rate at which the spin axis migrates toward the principle axis of maximum inertia is determined by and is directly proportional to the differential between the minimum moment of inertia and the maximum moment of inertia of the object. By increasing the differential of the maximum and minimum moments of inertia, the rate of migration is increased. As the maximum and minimum moments of inertia converge, the migration rate decrease. This can be thought of as the tendency of the object to seek a more stable axis of rotation. As the moment of inertia differential and hence stability differential is increased, the object moves more rapidly to a stable dynamic equilibrium.

It is the concept of establishing a principle axis of maximum moment of inertia or dominant axis upon which the invention relies. Unlike current bowling balls, the invention prossesses a line of maximum moment of inertia and a plane of potential minimum moments of inertial. This is accomplished by providing a relatively massive annular weight block 16, to establish a dominant spin axis for the ball about the y-axis shown in FIG. 3 and is relatively independent of the position of the finger holes. Described in its simplest terms, the spin axis of the ball will migrate predictably from the release spin axis prescribed by the bowler to the dominant spin axis. By knowledgeably drilling the finger holes, it is possible to place the bowler's release axis on the dominant spin axis of the ball or, alternatively, anywhere other than the dominant spin axis. By placing the release axis and the dominant spin axis coincidentally, a stable ball trajectory is created with no ball track flare or axis migration. When the release axis is positioned away from the dominant spin axis, a predictable axis migration is built into the ball.

Eccentric weight block 20 performs two important functions. When mass is removed from the bowling ball during the drilling of the finger holes, the symmetry of the ball is disrupted. However, when the holes are drilled near the position of the eccentric weight, that is, at the extreme top of the ball, the weight block compensates for the removed mass and renders the ball nearly symmetrical. The eccentric weight is positioned relative to the finger holes such that there is minimal residual weight due to the provision of the added weight. In this case, the above described products of inertia nearly vanish for a set of axes aligned as illustrated in FIGS. 2 and 3, with the y-axis being a principle axis of maximum inertia. When the finger holes are drilled away from the position of the eccentric weight block, the ball is not symmetric and the unbalanced weight of the eccentric weight block acts as a de-stabilizing influence. In this instance, however, the unstable wobbling or tumbling motion normally associated with a non-zero product of inertia triggers the migration of the spin axis toward the dominant axis established by the annular weight block. Where the ball might normally spin relatively about an intermediate axis, the induced dynamic imbalance will perturb the relative stability and facilitate the spin axis migration.

Another important feature of the present construction is the arrangement of different compositions with the shell and inner core. By centralizing the mass near the center of the ball by using a more denser material for the inner core, annular weight block, and eccentric weight block, a lower overall moment of inertia is created for the ball. Because the value of the maximum moment of inertia is dominated largely by the mass of the annular weight block and therefore remains relatively constant, the differential between the minimum moment of inertia and the maximum moment of inertia is increased. As described above, this feature results in more rapid migration of the spin axis from the bowler's release axis to the dominant principle axis of maximum inertia.

The migration of the spin axis serves an important function to a bowler. To achieve the highly desired curved path or "hook" in the trajectory of the bowling ball, a bowler takes advantage of the lubricating oil applied to the surface of bowling lanes. By interfacing different portions of the bowling ball with the oiled lane surface at different points along the lane, various frictional forces are developed which result in the "hooking" of the bowling ball. By controlling the spin of the bowling ball in a predictable way as described in detail above, it is possible to move different portions of the ball into contact with the oiled lane surface and thereby achieve a curved trajectory.

In an alternate embodiment of the invention as shown in FIGS. 4 and 5, a bowling ball comprises a three piece spherical body having an inner core 12' formed of a higher ratio mixture of barium sulfate to calcium carbonate and a polyester binder with an integral annular weight block 16' and eccentric weight block 20'. This is a significantly more dense composition than that of a lower barium sulfate to calcium carbonate ratio used in the inner core of the previous embodiment. The inner core is encapsulated by an outer shell 14' formed of a thinner layer of polyurethane than described in connection with the previous embodiment. An intermediate core 32 is formed between the inner core and the outer core and comprises a mixture of a polyester binder mixed with calcium carbonate and hollow glass microspheres. The microsphere provided for a lower density composition such that the overall weight of the ball is not increased when the density or mass of the inner core is increased. In this embodiment, the overall moment of inertia of the ball is further lowered and the differential between the minimum moment of inertia and the maximum moment of inertia is increased to accelerate the rate of migration of the spin axis from the bowler's release axis to the dominant axis of maximum moment of inertia defined by the central axis of the annular weight block.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A bowling ball exhibiting predictable dynamic characteristics comprising:

a spherical inner core composed of a first material;

a spherical outer shell composed of a second material and encapsulating the inner core; and an annular weight block projecting outwardly from and symmetrically encircling the inner core on a mid-plane thereof.

2. The bowling ball defined in claim 1 in which a plurality of grip holes are formed in the ball and establish a bowler release axis for the ball, and in which the annular weight block has a longitudinal axis of radial symmetry, with the longitudinal axis of the annular weight block being substantially parallel to the bowler release axis.

3. The bowling ball defined in claim 2 in which the longitudinal axis of the annular weight block is substantially coincident with the bowler release axis.

4. The bowling ball defined in claim 1 in which a plurality of grip holes are formed in the ball and help to establish a bowler release axis for the ball, and in which the annular weight block has a longitudinal axis of radial symmetry, with the longitudinal axis of the annular weight block being oriented at a preferred attitude relative to the bowler release axis for inducing migration of a bowling ball spin axis from the bowler release axis to the longitudinal axis of the annular weight block as it moves down a lane.

5. The bowling ball defined in claim 1 in which the density of the first material of the inner core and density of the second material of the outer shelf and the shape and density of the annular weight block are such that a ball axis coincident with a center longitudinal axis of the annular weight block is an axis of maximum moment of inertia in the bowling ball.

6. The bowling ball defined in claim 1 in which a plurality of grip holes are formed at a location on the ball, and in which the density of the first material of the inner core and density of the second material of the outer shell and the shape and density of the annular weight block define an axis of maximum moment of inertia for the bowling ball which is less dependent on the location of the grip holes.

7. The bowling ball defined in claim 6 in which the density of the first material of the inner core and density of the second material of the outer shell and the shape and density of the annular weight block are such that the products of inertia for all axes orthogonal to the dominant spin axis are sufficient to produce a stable trajectory for the ball as it slides and rolls down a lane.

8. The bowling ball defined in claim 1 in which the annular weight block is an axi-symmetric ring, and in which the bowling ball includes an eccentric weight block formed integrally with a portion of the annular weight block.

9. The bowling ball defined in claim 8 in which a plurality of grip holes are formed at a location on the ball, and in which the size and position of the eccentric weight block are such that there is minimal concentrated residual weight provided by the eccentric weight block after drilling.

10. The bowling ball defined in claim 1 in which the first material of the inner core and the annular weight block and the eccentric weight block have a common density.

11. The bowling ball defined in claim 1 in which the first material of the inner core includes barium sulfate calcium carbonate, or glass microspheres mixed with a binding resin.

12. The bowling ball defined in claim 11 in which the binding resin is further characterized as a polyester resin.

13. The bowling ball defined in claim 1 in which the second material of the outer shell has a density which is less than the density of the first material of the inner core.

14. The bowling ball defined in claim 13 in which the second material of the outer shell includes polyurethane.

15. A bowling ball exhibiting predictable dynamic characteristics when finger holes are formed therein comprising:

a two piece spherical body having an inner core formed of a first composition encapsulated by an outer shell formed of a second composition;

an annular weight block projecting outwardly from and symmetrically encircling the inner core on a mid-plane thereof, the annular weight block being axi-symmetric about a centerline passing through the geometric center of the spherical body; and an eccentric weight block formed integrally with a portion of the annular weight block, with the size and position of the eccentric weight block being such that there is minimal concentrated residual weight provided by the eccentric weight block after drilling.

16. The bowling ball defined in claim 15 in which the centerline of the annular weight block defines an axis of maximum moment of inertia in the bowling ball.

17. The bowling ball defined in claim 16 in which a plurality of grip holes are formed at a location on the ball, and in which the density of the inner core and density of the outer shell and the shape and density of the annular weight block and the shape and density and position of the eccentric weight block define an axis of maximum moment of inertia in the bowling ball which is less dependent on the location of the grip holes.

18. The bowling ball defined in claim 17 in which the density of the inner core and the density of the outer shell and the shape and density of the annular weight block and the shape and density and position of the eccentric weight block are such that the products of inertia for all axes perpendicular to the axis of maximum moment of inertia are sufficient to induce a migration of a bowling ball spin axis from a bowler release axis to the axis of maximum moment of inertia as it slides and rolls down a lane.

19. The bowling ball defined in claim 15 including an intermediate core formed of a third composition encapsulating the inner core and being encapsulated by the outer shell.

20. The bowling ball defined in claim 19 in which the third composition comprising the intermediate core has a lower density than the first composition comprising the inner core.

21. A bowling ball exhibiting predictable dynamic characteristics when drilled comprising:

a three piece spherical body having an inner core formed of a first composition encapsulated by an outer shell formed of a second composition with an intermediate core between the inner core and the outer shell and formed of a third composition: and annular weight block projecting outwardly from and symmetrically encircling the inner core on a mid-plane thereof, the annular weight block being axi-symmetric about a centerline passing through the geometric center of the spherical body.

22. The bowling ball defined in claim 21 having an eccentric weight block formed integrally with a portion of the annular weight block, with the size and position of the eccentric weight block being such that there is minimal concentrated residual weight provided by the eccentric weight block after drilling.

23. The bowling ball defined in claim 21 in which the first composition of the inner core includes barium sulfate, calcium carbonate or glass microspheres mixed with a binding resin.

24. The bowling ball defined in claim 23 in which the binding resin is further characterized as a polyester resin.

25. The bowling ball defined in claim 21 in which the second composition of the outer shell has a material density which is less than the material density of the first composition of the inner core.

26. The bowling ball defined in claim 21 in which the third composition of the intermediate core has a density reducing filler for decreasing an overall bowling ball moment of inertia.

27. The bowling ball defined in claim 26 in which the density reducing filler is characterized as hollow glass microspheres.

28. The bowling ball defined in claim 27 in which the density reducing filler is further characterized as calcium carbonate and hollow glass microspheres mixed with a binding resin.

29. The bowling ball defined in claim 28 in which the binding resin comprises a polyester resin.

30. The bowling ball defined in claim 21 in which the second composition of the outer shell comprises polyurethane.

* * * * *